United States Patent [19]

Stolka et al.

[11] Patent Number: 4,618,551

[45] Date of Patent: Oct. 21, 1986

[54] PHOTORESPONSIVE IMAGING MEMBERS WITH POLYSILYLENES HOLE TRANSPORTING COMPOSITIONS

[75] Inventors: Milan Stolka; Damodar M. Pai, both of Fairport; Thomas W. Smith, Penfield, all of N.Y.; James M. Duff, Mississauga; Rafik O. Loutfy, Willowdale, both of Canada

[73] Assignee: Xerox Corporation, Stamford, Conn.

[21] Appl. No.: 694,862

[22] Filed: Jan. 25, 1985

[51] Int. Cl.[4] ..... G03G 5/10

[52] U.S. Cl. ..... 430/58; 430/60; 430/62; 430/63

[58] Field of Search ..... 430/60, 62, 63, 58

[56] References Cited

U.S. PATENT DOCUMENTS 4,265,990 5/1981 Stolka et al. ..... 430/59

*Primary Examiner*—John Goodrow

*Attorney, Agent, or Firm*—E. V. Palazzo

[57] ABSTRACT

Disclosed is a polysilylene hole transporting compound for use in layered imaging members comprised of wherein $R_1$,$R_2$, $R_3$, $R_4$, $R_5$, and $R_6$ are independently selected from the group consisting of alkyl, aryl, substituted alkyl, substituted aryl, and alkoxy; and n, m, and p are numbers that represent the percentage of the monomer unit in the total polymer compound.

21 Claims, 6 Drawing Figures

PHOTORESPONSIVE IMAGING MEMBERS WITH POLYSILYLENES HOLE TRANSPORTING COMPOSITIONS

BACKGROUND OF THE INVENTION

This invention is generally directed to the use of new hole transporting compositions, and more specifically the present invention is directed to improved photoresponsive imaging members containing as hole transporting substances certain known polysilylene compositions. In one important embodiment of the present invention, there is provided a layered photoresponsive imaging member comprised of a polysilylenes hole transporting compound, and a photogenerating layer. Further, there is provided in one particular aspect of the present invention an improved layered photoresponsive imaging member comprised of a supporting substrate, a photogenerating layer, and in contact therewith a hole transport layer comprised of a polysilylene compound, especially poly(methylphenylsilylene), poly(m-propylmethylsilylene), and other similar silylenes. The layer with the polysilylenes hole transporting compound can be located as the top layer of the imaging member, or alternatively it may be situated between the supporting substrate and the photogenerating layer. Moreover, the present invention relates to the use of the improved imaging members disclosed in electrophotographic, and especially xerographic, imaging processes.

The formation and development of electrostatic latent images on the imaging surfaces of photoconductive materials by electrostatic means is well known, one such method involving the formation of an electrostatic latent image on the surface of a photosensitive plate, referred to in the art as a photoreceptor. The photoreceptor may comprise a conductive substrate containing on its surface a layer, or layers, of photoconductive insulating materials, and in many instances, there can be used a thin barrier layer between the substrate and the photoconductive layer to prevent charge injection from the substrate into the photoconductive layer upon charging of its surface, since charge injection would adversely affect the quality of the resulting image.

Numerous different photoconductive members for use in xerography are known, including, for example, a homogeneous layer of a single material such as vitreous selenium, or composite layered imaging members, with a photoconductive compound, dispersed in other substances. An example of one type of composite photoconductive layer used in xerography is described for example, in U.S. Pat. No. 3,121,006, wherein there is disclosed a number of layers comprising finely divided particles of a photoconductive inorganic compound dispersed in an electrically insulating organic resin binder. In a commercial form, the binder layer contains particles of zinc oxide uniformly dispersed in a resin binder and coated on a paper backing. The binder materials disclosed in this patent comprise a material which is incapable of transporting for any significant distance injected charge carriers generated by the photoconductive particles. Accordingly, as a result the photoconductive particles must be in a substantially contiguous particle to particle contact throughout the layer for the purpose of permitting charge dissipation required for a cyclic operation. Thus, with the uniform dispersion of photoconductive particles described a relatively high volume concentration of photoconductor material, about 50 percent by volume, is usually necessary in order to obtain sufficient photoconductor particle to particle contact for rapid discharge. These high photoconductive loadings can result in destroying the physical continuity of the resin thus significantly reducing the mechanical properties of the binder layer. Illustrative examples of specific binder materials disclosed in this patent include, for example, polycarbonate resins, polyester resins, polyamide resins, and the like.

There are also known photoreceptor materials comprised of other inorganic or organic materials wherein the charge carrier generation and charge carrier transport functions are accomplished by discrete contiguous layers. Additionally, photoreceptor materials are disclosed in the prior art which include an overcoating layer of an electrically insulating polymeric material, and in conjunction with this overcoated type photoreceptor there have been proposed a number of imaging methods. However, the art of xerography continues to advance and more stringent demands need to be met by the copying apparatus in order to increase performance standards, and to obtain higher quality images. The photoconductive imaging member of the present invention represents such an improved member, and has other advantages as disclosed hereinafter.

Recently, there has been developed layered photoresponsive imaging members, including those comprised of generating layers and transport layers as disclosed in U.S. Pat. No. 4,265,990, and overcoated photoresponsive materials with a hole injecting layer, overcoated with a transport layer, followed by an overcoating of a photogenerating layer and a top coating of an insulating organic resin, reference U.S. Pat. 4,251,612. Examples of generating layers disclosed in these patents include trigonal selenium and metal, or metal free phthalocyanines, while examples of the transport compounds that may be employed are comprised of certain aromatic amines as mentioned herein. The disclosures of each of these patents, namely, U.S. Pat. Nos. 4,265,990 and 4,251,612 are totally incorporated herein by reference. The U.S. Pat. No. 4,265,990 is of particular interest in that it discloses layered photoresponsive imaging members similar to those illustrated in the present application with the exception that the hole transporting substances of this patent are comprised of aryl amine compositions, while in accordance with the present invention the hole transporting substance is a polysilylene.

Many other patents are in existence describing photoresponsive imaging members including layered imaging members with generating substances such as U.S. Pat. No. 3,041,167, which describes an electrophotographic imaging member with an overcoated imaging member containing a conductive substrate, a photoconductive insulating layer, and an overcoating layer of an electrically insulating polymeric material. This member is utilized in an electrophotographic copying method by, for example, initially charging the member with an electrostatic charge of a first polarity, and imagewise exposing to form an electrostatic latent image which can be subsequently developed to form a visible image. Prior to each succeeding imaging cycle, the imaging member can be charged with an electrostatic charge of a second polarity, which is opposite in polarity to the first polarity. Sufficient additional charges of the second polarity are applied so as to create across the member a net electrical field of the second polarity. Simultaneously, mobile charges of the first polarity are created in the photoconductive layer such as by applying an electrical potential to the conductive substrate. The imaging potential which is developed to form the visible image is present across the photoconductive layer and the overcoating layer.

There is also disclosed in Belgium Pat. No. 763,540, an electrophotographic member having at least two electrically operative layers, the first layer comprising a photoconductive layer which is capable of photogenerating charge carriers, and injecting the photogenerated hole into a continuous active layer containing a transport organic material which is substantially non-absorbing in the spectral region of intended use, but which is active and allows injection of photogenerating holes from the photoconductive layer and provides for these holes to be transported through the active layer. The active compounds may be mixed with inactive polymers or non-polymeric materials.

In U.S. Pat. No. 3,041,116 there is disclosed a photoconductive material with a transparent plastic material overcoated on a layer of vitreous selenium, which is present on a recording substrate. Apparently, in operation, the free surface of the transparent plastic is electrostatically charged to a desired polarity, followed by exposing the imaging member to activating radiation, which generates a hole electron pair in the photoconductive layer and wherein the electrons move to the plastic layer and neutralize the positive charges contained on the free surface of the plastic layer, thus creating an electrostatic image. Also, there is disclosed in U.S. Pat. Nos. 4,232,102 and 4,233,383 the use of sodium carbonate doped and barium carbonate doped photoresponsive imaging members containing trigonal selenium. Other representative patents disclosing layered photoreponsive imaging members include U.S. Pat. Nos. 4,115,116, 4,047,949 and 4,081,274.

While imaging members various hole transporting substances, including aryl amines are suitable for their intended purposes, there continues to be a need for the development of improved members, particular layered members, which are comprised of new hole transporting substances. Moreover there continues to be a need for specific layered imaging members which not only generate acceptable images, but which can be repeatedly used in a number of imaging cycles without deterioration thereof from the machine environment or surrounding conditions. Additionally, there continues to be a need for improved layered imaging members wherein the materials employed for the respective layers, particularly the hole transporting layer, are substantially inert to the users of these members. Further, there continues to be a need for improved photoresponsive imaging members which can be prepared with a minimum number of processing steps, and wherein the layers are sufficiently adhered to one another to allow the continuous use of these imaging members in repetitive imaging processes. Also, there continues to be a need for new hole transporting compounds that are also useful as protective overcoating layers, and as interface materials for various imaging members. Furthermore, the hole transporting polysilylenes compositions of the present invention may be useful as binder polymers for photogenerating substances comprised of organic materials. There also is a need for new hole transporting substances which enable increased mobility of holes in layered imaging members. Likewise, there is a need for hole transporting compounds with increased stability, for example wherein there is no extraction of these compounds from the layered imaging members in which they are incorporated, when for instance liquid developers are selected for rendering the latent electrostatic latent image visible. Furthermore, there is a need for hole transporting compounds useful in layered imaging members, which compounds are superior insulators in the dark, compared to many other known hole transporting compounds, thus enabling charging of the resulting imaging member to higher fields, while maintaining cyclic stability, and allowing improved developabilty. Also, there is a need for imaging members with new hole transporting compounds, which can function as resinous binders. Additionally, there is a need for enabling the preparation of imaging members with new hole transporting compounds, wherein the preparation allows for the selection of a variety of solvents, inclusive of toluene, benzene, tetrahydrofuran, cyclohexane, and halogenated solvents, in addition to methylene chloride.

SUMMARY OF THE INVENTION

It is therefore an object of the present invention to provide improved photoresponsive imaging members with new hole transporting compositions.

It is another object of the present invention to provide layered photoresponsive imaging members containing therein polysilylenes hole transporting substances.

In a further object of the present invention there is provided an improved layered photoresponsive imaging member with a photogenerating layer situated between a supporting substrate, and a hole transport layer comprised of the polysilylenes disclosed hereinafter.

In yet another object of the present invention there is provided an improved photoresponsive imaging member comprised of polysilylenes hole transporting compound layer situated between a supporting substrate, and a photogenerating layer, or layers.

In still yet another object of the present invention there is provided an improved photoresponsive imaging member comprised of hole transporting compounds, and photogenerating pigments, and as a protective overcoating the polysilylenes compositions disclosed hereinafter.

In yet another object of the present invention there is provided an improved photoresponsive imaging member wherein the polysilylenes compositions illustrated herein function as binder polymers for the photogenerating pigments.

In an additional object of the present invention there is provided an amorphous silicon photoresponsive imaging member, with a protective overcoating thereover of the polysilylenes compositions disclosed herein.

In yet another object of the present invention there is provided imaging methods with the improved imaging members illustrated.

Another object of the present invention resides in the provision of layered imaging members comprised of hole transporting polysilylene compounds enabling improved insulating characteristics in the dark for the resulting member, thus allowing charging to higher fields while maintaining cyclic stability, and improving developability.

Another further object of the present invention resides in the provision of layered imaging members comprised of hole transporting polysilylene compounds of improved stability, thus undesirably avoiding extraction of the hole transport compound with, for example, liquid developer compositions.

In yet an additional object of the present invention there are provided layered imaging members which can be prepared with a variety of solvents, including toluene, benzene, tetrahydrofuran, and halogenated hydrocarbons, in addition to methylene chloride.

These and other objects of the present invention are accomplished by the provision of new hole transporting compositions comprised of polysilylenes. More specifically, the present invention is directed to an improved photoresponsive imaging member comprised of a photogenerating layer, and in contact therewith a hole transporting layer comprised of polysilylenes compositions of matter.

In one specific embodiment, the present invention is directed to an improved photoresponsive imaging member comprised of a supporting substrate, a photogenerating layer comprised of inorganic, or organic photoconductive pigments, optionally dispersed in an inactive resinous binder, and a top overcoating layer comprised of a polysilylene hole transporting compound. Another specific photoresponsive imaging member of the present invention is comprised of the polysilylene hole transporting layer situated between a supporting substrate, and the photogenerating layer.

The polysilylene hole transporting compounds of the present invention include generally polymers, especially homopolymers, copolymers, or terpolymers, of the following formula:

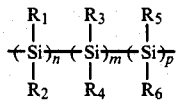

wherein $R_1$, $R_2$, $R_3$, $R_4$, $R_5$, and $R_6$, are independently selected from the group consisting of alkyl, aryl, substituted alkyl, substituted aryl, and alkoxy; and m, n, and p are numbers that reflect the percentage of the particular monomer unit in the total polymer composition, with the sum of n plus m plus p being equal to 100 percent. Specifically thus for example, zero percent is less than, or equal to n, and n is less than, or equal to 100 percent; and zero percent is less than, or equal to m, and m is less than, or equal to 100 percent; and zero percent is less than, or equal to p, and p is less than, or equal to 100 percent. Any of the monomer units of the polysilylene can be randomly distributed throughout the polymer, or may alternatively be in blocks of varying lengths.

One preferred polysilylene hole transporting compound of the present invention is a poly(methylphenylsilylene) of the following formula:

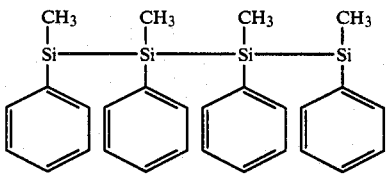

which silylene has a weight average molecular weight of in excess of 50,000 and preferably is of a weight average molecular weight of from about 75,000 to about 1,000,000. Similarly the polysilylenes of the general formula illustrated hereinbefore are of a weight average molecular weight of in excess of 50,000 and preferably are of a weight average molecular weight of from about 75,000 to about 2,000,000, and preferably of from about 300,000 to about 800,000.

Examples of alkyl groups include those that are linear, or branched, of from one carbon atom to about 24 carbon atoms, and preferably from about 1 carbon atom to about eight carbon atoms, inclusive of methyl, ethyl, propyl, butyl, amyl, hexyl, octyl, nonyl, decyl, pentadecyl, stearyl; and unsaturated alkyls inclusive of allyls, and other similar substituents. Specific preferred alkyl groups are methyl, ethyl, propyl, and butyl. Aryl substituents are those of from 6 carbon atoms to about 24 carbon atoms, inclusive of phenyl, naphthyl, anthryl, and the like. These alkyl and aryl groups may be substituted with alkyl, aryl, halogen, nitro, amino, alkoxy, cyano, and other related substituents.

Examples of alkoxy groups include those with from 1 carbon atom to about 10 carbon atoms, such as methoxy, ethoxy, propoxy, butoxy, and other similar substituents.

Illustrative specific examples of polysilylenes hole transporting compounds included within the scope of the present invention, and encompassed within the formulas illustrated hereinbefore are poly(methylphenylsilylene), poly(methylphenylsilylene-co-dimethylsilylene), poly(cyclohexylmethylsilylene), poly(tertiarybutylmethylsilylene), poly(phenyl ethylsilylene), poly(n-propyl methylsilylene), poly(p-tolyl methylsilylene), poly(cyclotrimethylenesilylene), poly(cyclotetramethylene silylene), poly(cyclopentamethylenesilylene), poly(di-t-butylsilylene-co-dimethylsilylene), poly(diphenylsilylene-co- phenylmethylsilylene), poly(cyanoethyl methylsilylene), poly(2-acetoxyethyl methylsilylene), poly(2-carbomethoxyethyl methylsilylene), poly(phenyl methylsilylene), about 60 percent, with about 40 percent by weight of a dispersed aryl amine, especially N,N'-bis(3-methyl phenyl)1,1'-biphenyl-4,4'-diamine.

The improved photoresponsive imaging members of the present invention can be prepared by a number of known methods, the process parameters and the order of the coating of the layers being dependent on the member desired. Thus, for example, the improved photoresponsive members of the present invention can be prepared by providing a conductive substrate with an optional hole blocking layer, and optional adhesive layer, and applying thereto by solvent coating processes, laminating processes, or other methods, a photogenerating layer, and the polysilylene hole transport layer. Other methods include melt extrusion, dipcoating, and spraying.

BRIEF DESCRIPTION OF THE DRAWINGS

For a better understanding of the present invention and further features thereof, reference is made to the following detailed description of various embodiments wherein.

As overcoatings for these members there can be selected an aryl amine dispersed in a resin binder, inclusive of polycarbonates, containing carbon black. The carbon black is usually present in various amounts, however, from about 5 percent to about 15 percent of carbon black are preferred.

DESCRIPTION OF THE PREFERRED EMBODIMENTS

Figure 1:
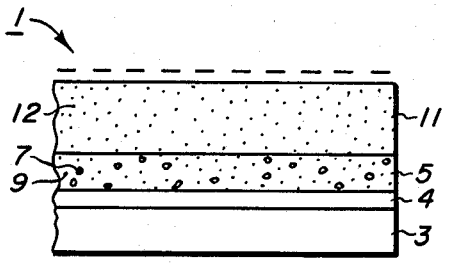
FIG. 1 is a partially schematic cross-sectional view of the improved photoresponsive imaging member of the present invention.

Illustrated in FIG. 1 is a negatively charged improved photoresponsive imaging member of the present invention, generally designated 1, and comprising a supporting substrate 3, an optional adhesive blocking layer 4, a charge carrier photogenerating layer 5, comprised of a photogenerating pigment 7, optionally dispersed in inactive resinous binder composition 9, and hole transport layer 11, comprised of a polysilylene hole transporting compound 12. In an alternative embodiment of the present invention, and in further regard to FIG. 1, the hole transporting layer can be situated between the supporting substrate and the photogenerating layer, resulting in a positively charged imaging member.

Figure 2:
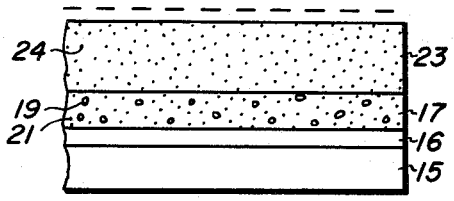
FIG. 2 represents a partially schematic cross-sectional view of a photoresponsive imaging member of the present invention.

Illustrated in FIG. 2 is a negatively charged photoresponsive imaging member of the present invention comprised of a conductive supporting substrate 15, of aluminized Mylar, an optional adhesive blocking layer 16, a photogenerating layer 17 comprised of a trigonal selenium photogenerating pigment 19; or other similar inorganic pigments, as well as organic pigments, dispersed in a resinous binder 21 other than polysilylenes, and a hole transport layer 23, comprised of a poly(methylphenylsilylene) 24, of a weight average molecular weight of greater than 50,000.

Figure 3:
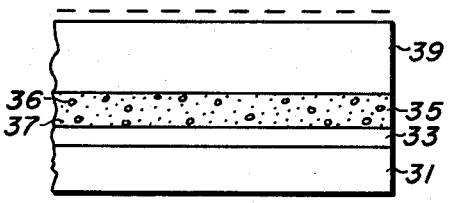
FIG. 3 represents a partially schematic cross-sectional view of the photoresponsive imaging member of the present invention including therein an optional/-blocking adhesive layer.

Illustrated in FIG. 3 is a negatively charged photoresponsive imaging member of the present invention comprised of a conductive supporting substrate 31 of aluminized Mylar; an optional adhesive blocking layer 33; a photogenerating layer 35 comprised of an inorganic, or organic photogenerating pigment 36, inclusive of trigonal selenium; vanadyl phthalocyanine; cadmium-sulfur-selenide, dispersed in a polysilylene resinous binder 37; and a hole transport layer 39, comprised of a poly(methylphenylsilylene).

Figure 4:
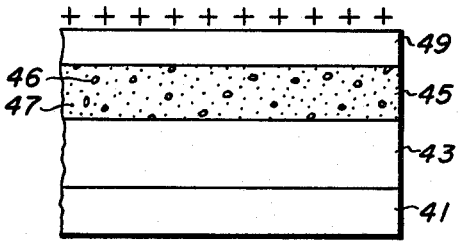
FIG. 4 represents a partially schematic cross-sectional view of the photoresponsive imaging member of the present invention wherein the polysilylene hole transporting compound is situated between a supporting substrate, and a photogenerating layer.

Illustrated in FIG. 4 is a positively charged photoresponsive imaging member of the present invention comprised of a conductive supporting substrate 41, of aluminized Mylar; a hole transporting layer 43, comprised of the polysilylenes illustrated herein; a photogenerating layer 45 comprised of an inorganic, or organic photogenerating pigment 46, inclusive of amorphous selenium; trigonal selenium; vanadyl phthalocyanine; cadmium-sulfur-selenide, optionally dispersed in a resinous binder 47; and a protective overcoating layer 49. The resinous binder for the imaging member of this Figure are the polysilylenes as disclosed hereinabefore.

Figure 5:
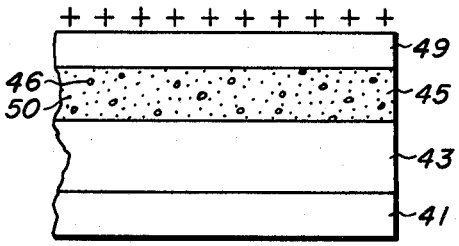
FIGS. 5, and 6, represent partially schematic cross-sectional views of further photoresponsive imaging members of the present invention.

Illustrated in FIG. 5 is a positively charged photoresponsive imaging member of the present invention, substantially equivalent to the member of FIG. 4, with the primary exception that the photogenerating pigments are dispersed in resinous binders 50, other than the polysilylenes illustrated herein. In FIG. 5, like reference numerals represent the same components.

Alternatively with regard to FIG. 5, similar imaging members are envisioned with the primary exception that the photogenerating pigments are not dispersed in resinous binders, and are primarily in a preferred embodiment evaporated amorphous selenium, evapoated amorphous selenium alloys, including selenium tellurium, selenium-arsenic, and evaporated organic pigments inclusive of vanadyl phthalocyanine, metal free phthalocyanines, metal phthalocyanines, and squaraines.

Figure 6:
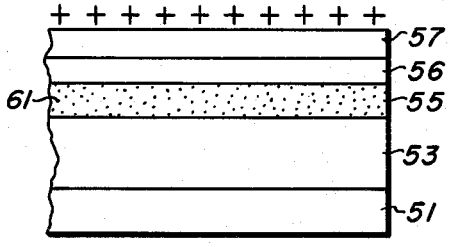

Illustrated in FIG. 6 is a positively charged photoresponsive imaging member of the present invention, comprised of a conductive supporting substrate 51; a hole transport layer 53, comprised of a poly(methylphenylsilylene); a photogenerating layer 55, comprised of an inorganic, or organic photogenerating pigment dispersed in a resinous binder 61, comprised of the polysilylenes illustrated herein, or other known inactive resinous binders; a blocking layer 56; and an overcoating layer 57, comprised of aryl amines dispersed in a resinous binder, such as polycarbonates, which overcoating also contains therein carbon black particles. These overcoatings do not retain charge, reference copending application U.S. Ser. No. 567,840/84, the disclosure of which is totally incorporated herein by reference.

The supporting substrate layers, except as specifically mentioned with regard to FIGS. 1 to 6, may be opaque or substantially transparent and may comprise any suitable material having the requisite mechanical properties. Thus these substrates may comprise a layer of non-conducting material, such as an inorganic or organic polymeric material, a layer of an organic or inorganic material having a conductive surface layer arranged thereon or a conductive material such as, for example, aluminum, chromium, nickel, indium, tin oxide, brass or the like. The substrate may be flexible or rigid and may have any of many different configurations such as, for example, a plate, a cylindrical drum, a scroll, an endless flexible belt and the like. Preferably, the substrate is in the form of an endless flexible belt.

The thickness of the substrate layer depends on many factors, including economical considerations. Thus this layer may be of substantial thickness, for example, over 100 mils or minimum thickness providing there are no adverse effects on the system. In one preferred embodiment the thickness of this layer ranges from about 3 mils to about 10 mils.

Examples of the photogenerating pigments are as illustrated herein, inclusive of amorphous selenium, selenium alloys, such as $As_2Se_3$, trigonal selenium, metal free phthalocyanines, metal phthalocyanines, vanadyl phthalocyanines, squaraines, and the like, with $As_2Se_3$ being preferred.

Also useful as photogenerators are hydrogenated amorphous silicon, germanium, and silicon-germanium alloys. Typically, this layer is of a thickness of from about 0.3 microns to about 10 microns or more in thickness, however, dependent on the photoconductive volume loading which may vary from 5 to 100 volume percent, this layer can be of other thicknesses, and is preferably from about 0.3 microns to about 3 microns in thickness. Generally, it is desirable to provide this layer in a thickness which is sufficient to absorb about 90 percent or more of the incident radiation which is directed upon it in the imagewise exposure step. The maximum thickness of this layer is dependent primarily upon facts such as mechanical considerations, for example whether a flexible photoresponsive imaging member is desired.

Optional resin binders for the photogenerating pigments are, for example, the polymers as illustrated in U.S. Pat. No. 3,121,006, the disclosure of which is totally incorporated herein by reference, polyesters, polyvinylbutyrals, polyvinylcarbazoles, polycarbonate resins, epoxy resins, polyhydroxyether resins, and the like. This layer can be of other thicknesses providing the objectives of the present invention are achieved, thus for example when evaporated photogenerating pigments are selected the thickness of this layer is from about 0.5 microns to about 3 microns.

The hole carrier transport layers for the imaging members of the present invention are comprised of the polysilylenes compounds illustrated herein. This layer is generally of a thickness of from about 2 microns to about 50 microns, and preferably from about 5 microns to about 30 microns. These polysilylenes were prepared by known methods, reference for example the Journal Of Organometallic Chemistry, Page 198, C27 (1980), R. E. Trujillo, the disclosure of which is totally incorporated herein by reference. Also other polysilylenes of the present invention can be prepared as described in The Journal Of Polymer Science, Polymer Chemistry Edition, Volume 22, pages 159 to 170, (1984), John Wiley and Sons Inc., the disclosure of which is totally incorporated herein by reference; and the Journal of Polymer Science, Polymer Chemistry Edition, Volume 22, pages 225 to 238, (1984) John Wiley and Sons Inc.), the disclosure of which is totally incoporated herein by reference. These three articles illustrate the types of polysilylenes that are useful as the hole transporting molecules of the present invention. Moreover, it is noted that the polymers in these references are referred to as organosilanes, however, with respect to the present invention these compounds are referred to as polysilylenes. More specifically, the polysilylenes can be prepared as disclosed in this article by the condensation of a dichloromethylphenyl silane with an alkali metal, such as sodium. In one preparation sequence there is reacted a dichloromethylphenyl silane, in an amount of from about 0.1 moles, with sodium metal, in the presence of 200 milliliters of solvent, and wherein the reaction is accomplished at a temperature of from about 100 degrees Centigrade to about 140 degrees Centigrade. There results, as identified by elemental analysis, infrared spectroscopy, UV spectroscopy, and nuclear magnetic resonance. the polysilylenes products subsequent to the separation thereof from the reaction mixture.

The polysilylenes of the present invention are also useful as protective overcoating materials for various photoreceptor members including amorphous selenium, selenium alloys, hydrogenated amorphous silicon, layered members containing selenium arsenic alloys as the top layer, reference U.S. Pat. No. 487,935/83, the disclosure of which is totally incorporated herein by reference; and layered imaging members comprised of a photogenerating layer, and a diamine hole transport layer, reference U.S. Pat. No. 4,265,990 referred to hereinbefore. In this embodiment the polysilylenes are applied as an overcoating to the imaging member in a thickness of from about 0.5 microns to about 7.0 microns, and preferably from about 1.0 micron to about 4.0 microns. Moreover, as indicated herein the polysilylene compositions of the present invention can be selected as resinous binders for the imaging members described herein, including inorganic, and organic photogenerators such as trigonal selenium, selenium alloys, hydrogenated amorphous silicon, silicon-germanium alloys, and vanadyl phthalocyanine. In this embodiment, for example the imaging member is comprised of a supporting substrate, a photogenerating layer comprised of a photogenerating pigment of trigonal selenium, or vanadyl phthalocyanine, dispersed in the polysilylenes composition, which are now functioning as a resinous binder, and as a top layer an aryl amine hole transport composition, reference the U.S. Pat. No. 4,265,990 mentioned herein, or polysilylenes.

Further, the polysilylenes compositions of the present invention may also function as interface layers. As interface layers the polysilylenes are applied between, for example, a supporting substrate and the photogenerating layer, or the photogenerating layer and the hole transport layer, wherein these polymers provide improved adhesion of the respective layers. Other interface layers useful for the imaging members of the present invention include, for example polyesters, and similar equivalent materials. These adhesive layers are of a thickness of from about 0.05 micron to about 2 microns.

The imaging members of the present invention are useful in various electrophotographic imaging systems, especially xerographic systems, wherein an electrostatic image is formed on the photoresponsive imaging member, followed by the development thereof, transfer to a suitable substrate, and fixing of the resultant image.

The invention will now be described in detail with respect to specific preferred embodiments thereof, it being understood that these examples are intended to be illustrative only, the invention is not intended to be limited to the materials, conditions, process parameters, etc. recited herein. All parts and percentages are by weight unless otherwise indicated.

EXAMPLE I

There was prepared a photoresponsive imaging member by providing an aluminized Mylar substrate in a thickness of 3 mils, followed by applying thereto with a multiple clearance film applicator, in a wet thickness of 0.5 mils, a layer of 3-aminopropyltriethoxysilane, available from PCR Research Chemicals of Florida, in ethanol in a 1:50 volume ratio. This layer was then allowed to dry for 5 minutes at room temperature, followed by curing for 10 minutes at 110 degrees Centigrade in a forced air oven. A photogenerating layer of amorphous selenium, in a thickness of 0.4 microns was then applied to the silane layer. Thereafter the amorphous selenium photogenerating layer was overcoated with a transport layer of poly(methylphenylsilylene) from a solution of toluene in tetrahydrofuran, volume ratio of 2:1, this deposition being effected by spraying. There resulted after drying a charge transport layer of 10 microns in thickness.

Electrostatic latent images were then generated on the above prepared imaging member subsequent to its incorporation into a xerographic imaging test fixture, and after charging the member to a negative voltage of 1,000 volts. Thereafter, the resulting images were developed with a toner composition comprised of 92 percent by weight of a styrene nbutylmethacrylate copolymer, (58/42), 8 percent by weight of carbon black particles, and 2 percent by weight of the charge enhancing additive cetyl pyridinium chloride. There resulted, as determined by visual observation, developed images of excellent resolution, and superior quality for 25,000 imaging cycles. Further, it was determined that the polysilylene charge transport layer retained its insulating characteristics in the dark as evidenced, for example, by measurements of the initial decay of voltage of the photoreceptor, as measured with an electrometer, which was 25 volts per second at the beginning, and at the end of this test, that is about 25,000 imaging cycles. This enables the imaging member to be charged to higher fields while at the same time maintaining the cyclic stability of the member, and providing for improved developabilty for the images generated.

This imaging member was then charged to a minus −600 volts by a corona, which charge was measured with an electrometer immediately after charging, about 0.2 seconds. In 60 seconds the potential on the member dropped to only −575 volts, equivalent to a more than acceptable dark decay of about 25 volts per minute. Also most of this potential drop occured within the first 2 to 3 seconds. The charging sequence was repeated with the exception that the imaging member was initially charged to a potential of −1,000 volts; and the initial dark decay was only about 20 volts per second.

In contrast with an imaging member containing an aluminized Mylar substrate, a photogenerating layer of trigonal selenium dispersed in polyvinylcarbazole coated thereover, and as a top charge transport layer the aryl amine N,N'-diphenyl-N,N'-bis(3-methylphenyl)1,1'-biphenyl-4,4'-diamine dispersed in a polycarbonate resinous binder, the initial dark decay was 120 to 150 volts per second. Accordingly, the imaging member with the polysilylene transport layer had much lower dark decay at higher electric fields than the member with the aryl amine hole transport layer at fields of 30 volts per micron.

EXAMPLE II

A photoresponsive imaging member was prepared by repeating the procedure of Example I, with the exception that there was selected as the photogenerating pigment in place of the amorphous selenium, an arsenic selenium alloy, 99.9 percent by weight of selenium, and 0.5 percent by weight of arsenic. Substantially similar results were generated when this imaging member was used to achieve images for 25,000 cycles in accordance with the procedure of Example I.

EXAMPLE III

Numerous photoresponsive imaging members were prepared by repeating the procedure of Example I with the exception that the following components were selected for the supporting substrate, the interface layer, the photogenerating layer, and the charge transport layer. Additionally, other imaging members were prepared by repeating the procedure of Example I, with the exception that there was included as a further layer an overcoating, of for example, a silicone resin, reference for example U.S. Ser. No. 346,423/82, the disclosure of which is totally incorporated herein by reference. Further, other imaging members were prepared with a top overcoating of an aryl amine, dispersed in a polycarbonate resin, and containing carbon black therein. The thickness of the layers in each instance were as follows unless otherwise noted: substrate, about 3 mils; interface, about 0.1 microns; generator, about 0.5 microns; transport, about 15 microns; and overcoat, about 5 microns. Also for some of the specific generators, the photogenerating pigment was present in an amount of about 30 percent by weight dispersed in about 70 percent by weight of the resin binder recited.

| | |
|---|---|
| | Member A |
| 1. substrate | aluminized Mylar |
| 2. interface | plasma treated aluminum |
| 3. generator | amorphous selenium |
| 4. transport | poly(methylphenylsilylene) |
| | Member B |
| 1. substrate | nickel belt, thickness 4 mils. |
| 2. interface | triethoxysilane* |
| 3. generator | trigonal selenium/PVK |
| 4. transport | poly(methylphenylsilylene) |
| | Member C |
| 1. substrate | Ti-coated Mylar |
| 2. interface | triethoxysilane |
| 3. generator | trigonal selenium/PVK |
| 4. transport | poly(methylphenylsilylene), or poly(n-propylmethylsilylene co-methylphenylsilylene). |
| | Member D |
| 1. substrate | nickel belt |
| 2. interface | triethoxysilane |
| 3. generator | VOPc(vanadyl phthalocyanine) dispersed in PE-1000 polyester |
| 4. transport | poly(methylphenylsilylene-co-dimethylsilylene) |
| | Member E |
| 1. substrate | aluminized Mylar |
| 2. interface | triethoxysilane |
| 3. generator | CdSSe/polycarbonate |
| 4. transport | poly(cyclohexylmethylsilylene) |
| | Member F |
| 1. substrate | Ti-coated Mylar |
| 2. interface | triethoxysilane |
| 3. generator | Se—Te alloy (75/25) |
| 4. transport | poly(methylphenylsilylene) |
| | Member G |
| 1. substrate | aluminized Mylar |
| 2. interface | triethoxysilane |
| 3. generator | $As_2Se_3$(40/60) |
| 4. transport | poly(methylphenylsilylene-co-dimethylsilylene) |
| | Member H |
| 1. substrate | aluminized Mylar |
| 2. interface | triethoxysilane |
| 3. generator | hydroxy squarylium in polycarbonate. |
| 4. transport | poly(diphenylsilylene-co-methylphenylsilylene) |
| | Member I |
| 1. substrate | aluminized Mylar |
| 2. interface | triethoxysilane |
| 3. generator | thiapyrillium dye in polycarbonate |
| 4. transport | poly(cyclotetramethylenesilylene) |
| | Member J |
| 1. substrate | aluminum plate |
| 2. interface | triethoxysilane |
| 3. generator | VOPc/PE-100 polyester |
| 4. transport | poly(para-tolylmethylsilylene) |
| | Member K |
| 1. substrate | nickel belt |
| 2. interface | triethoxysilane |
| 3. generator | thiapyrillium dye in polycarbonate |
| 4. transport | poly(methylphenylsilylene) |
| | Member L |
| 1. substrate | nickel belt |
| 2. interface | triethoxysilane |
| 3. generator | thiapyrillium dye |
| 4. transport | poly(methylphenylsilylene) N,N'—diphenyl-N,N'—bis(3-methylphenyl)1,1'-biphenyl-4,4'-diamine, (60/40) |
| | Member M |
| 1. substrate | aluminized Mylar |
| 2. interface | triethoxysilane |
| 3. generator | trigonal Se/PVK, polycarbazole |
| 4. transport | poly(methylphenylsilylene) |
| 5. overcoat | silicone resin, 2 microns. |
| | Member N |

-continued

| | |
|---|---|
| 1. substrate | aluminized Mylar |
| 2. interface | triethoxysilane |
| 3. generator | trigonal Se/PVK |
| 4. transport | poly(methylphenylsilylene) |
| 5. overcoat | N,N'—diphenyl-N,N'—bis(3-methylphenyl)1,1'-biphenyl-4,4'-diamine, 40 percent, dispersed in polycarbonate, 60 pecent, and 10 percent of carbon black. |
| | Member O |
| 1. substrate | aluminized Mylar |
| 2. interface | triethoxysilane |
| 3. generator | trigonal Se/PVK |
| 4. transport | poly(n-propylmethylsilylene) |
| 5. overcoat | N,N'—diphenyl-N,N'—bis(3-methylphenyl)1,1'-biphenyl-4,4'-diamine, 40 percent, dispersed in polycarbonate, 60 percent, and 10 percent of carbon black. |
| | Member P |
| 1. substrate | aluminized Mylar |
| 2. interface | triethoxysilane |
| 3. generator | trigonal Se/PVK |
| 4. transport | poly(t-butylmethylsilylene) |
| 5. overcoat | N,N'—diphenyl-N,N'—bis(3-methylphenyl)1,1'-biphenyl-4,4'-diamine, 40 percent, dispersed in polycarbonate, 60 percent, and 10 percent of carbon black. |

*refers throughout to 3-aminopropyltriethoxysilane, hydrolyzed, and cured.

Moreover, there were prepared substantially similar photoresponsive imaging members with the exception that the charge transport layer was positioned between the supporting substrate, and the photogenerating layer, and the interface layer was eliminated. These imaging members are particularly useful when positively charged.

Furthermore, photoresponsive imaging members can be prepared which are sensitive to both the visible and infrared region of the spectrum, thereby allowing these members to be sensitive to either visible light, and/or infrared light. This is accomplished by including in the imaging member two photogenerating layers, one of which is responsive to visible light, and one of which is sensitive to infrared light. In this embodiment of the present invention thus the photoresponsive imaging member can be comprised of a supporting substrate, a photogenerating layer of trigonal selenium, a second photogenerating layer of vanadyl phthalocyanine, and a hole transport layer comprised of the polysilylenes of the present invention. In a further embodiment of the present invention the imaging member is comprised of a supporting substrate; a polysilylene hole transport layer; a photogenerating layer of, for example, vanadyl phthalocyanine dispersed in a polyester resinous binder; and a top overcoating layer of seleinum, or selenium alloy, reference U.S. Ser. No. 487,935/83, the disclosure of which is totally incorporated herein by reference.

Although the invention has been described with reference to specific preferred embodiments, it is not intended to be limited thereto, rather those skilled in the art will recognize variations and modifications may be made therein which are within the spirit of the invention and within the scope of the following claims.

We claim:

1. An improved layered photoresponsive imaging member comprised of a supporting substrate, a photogenerating layer, comprised of inorganic or organic photoconductive pigments, and as a hole transport layer in contact therewith a polysilylene compound of the formula

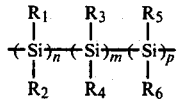

wherein $R_1$, $R_2$, $R_3$, $R_4$, $R_5$ and $R_6$ are independently selected from the group consisting of alkyl, aryl, substituted alkyl, substituted aryl, and alkoxy; and n, m, and p are numbers that represent the percentage of the monomer unit in the polysilylene.

2. An improved layered photoresponsive imaging member comprised of a supporting substrate, a photogenerating layer, comprised of inorganic or organic photoconductive pigments, and situated therebetween a polysilylene hole transport layer comprised of the polysilylene compound of the formula

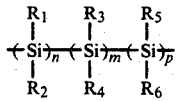

wherein $R_1$, $R_2$, $R_3$, $R_4$, $R_5$ and $R_6$ are independently selected from the group consisting of alkyl, aryl, substituted alkyl, substituted aryl, and alkoxy; and n, m, and p are numbers that represent the percentage of the monomer unit in the polysilylene.

3. An improved layered photoresponsive imaging member in accordance with claim 1 wherein the supporting substrate is conductive.

4. An improved layered photoresponsive imaging member in accordance with claim 1 wherein the photogenerating layer is comprised of photogenerating pigments selected from inorganic photoconductive pigments, and organic photoconductive pigments.

5. An improved layered photoresponsive imaging member in accordance with claim 4 wherein the inorganic pigments are amorphous selenium, selenium alloys, or trigonal selenium.

6. An improved layered photoresponsive imaging member in accordance with claim 4 wherein the organic pigments are metal phthalocyanines, metal free phthalocyanines, or vanadyl phthalocyanine.

7. An improved layered photoresponsive imaging member in accordance with claim 1 wherein the polysilylene is poly(methylphenylsilylene).

8. An improved layered photoresponsive imaging member in accordance with claim 1 wherein the polysilylene is poly(n-propylmethylsilylene)-co-methylphenylsilylene).

9. An improved layered photoresponsive imaging member in accordance with claim 2 wherein the polysilylene is poly(n-propylmethylsilylene)

10. An imaging member in accordance with claim 1, wherein there is further included as a separate top layer a protective overcoating.

11. An imaging member in accordance with claim 2, wherein there is further included as a separate top layer a protective overcoating.

12. A process for generating developed electrostatic latent images which comprises providing the imaging member of claim 1, and forming thereon an electrostatic latent image, thereafter accomplishing the development of this image, subsequently transferring the developed image to a suitable substrate, and optionally permanently affixing the image thereto.

13. A process for generating developed electrostatic latent images which comprises providing the imaging member of claim 2, and forming thereon an electrostaic latent image, thereafter accomplishing the development of this image, subsequently transferring the developed image to a suitable substrate, and optionally permanently affixing the image thereto.

14. A process for generating developed electrostatic latent images in accordance with claim 12, wherein the polysilylene is poly(methylphenylsilylene), poly(n-propyl-methylsilylene)-comethylphenylsilylene), or poly(n-propylmethylsilylene).

15. A process for generating developed electrostatic latent images in accordance with claim 13, wherein the polysilylene is poly(methylphenylsilylene), poly(n-propyl-methylsilylene)-comethylphenylsilylene), or poly(n-propylmethylsilylene).

16. An improved layered photoresponsive imaging member in accordance with claim 1 wherein the supporting substrate is of a thickness of from about 3 mils to about 10 mils; the photogenerating layer is of a thickness of from about 0.3 micron to about 10 microns; and the polysilylene hole transport layer is of a thickness of from about 2 microns to about 50 microns.

17. An improved layered photoresponsive imaging member in accordance with claim 2 wherein the supporting substrate is of a thickness of from about 3 mils to about 10 mils; the photogenerating layer is of a thickness of from about 0.3 micron to about 10 microns; and the polysilylene hole transport layer is of a thickness of from about 2 microns to about 50 microns.

18. An improved layered photoresponsive imaging member in accordance with claim 1 wherein the photogenerating layer is dispersed in a resinous binder.

19. An improved layered photoresponsive imaging member in accordance with claim 1 wherein the charge transport layer is dispersed in a resinous binder.

20. An improved layered photoresponsive imaging member in accordance with claim 2 wherein the photogenerating layer is dispersed in a resinous binder.

21. An improved layered photoresponsive imaging member in accordance with claim 2 wherein the charge transport layer is dispersed in a binder.

* * * * *